US005127612A

United States Patent [19]

Onstott

[11] Patent Number: 5,127,612

[45] Date of Patent: Jul. 7, 1992

[54] SPRING-LOADED FLEXIBLE KITE STRAP HANDLE AND LINE CADDY

[75] Inventor: Brent O. Onstott, 4218 Prothro, Wichita Falls, Tex. 76308

[73] Assignee: Brent O. Onstott, Wichita Falls, Tex.

[21] Appl. No.: 796,375

[22] Filed: Nov. 22, 1991

[51] Int. Cl.[5] ..... B64C 31/06

[52] U.S. Cl. ..... 244/155 R; 244/155 A; 242/96

[58] Field of Search ..... 244/155 R, 155 A; 446/31, 32; 242/96

[56] References Cited

U.S. PATENT DOCUMENTS

| | | | |
|---|---|---|---|
| 4,653,702 | 3/1987 | McGinnis | 244/155 A |
| 4,714,217 | 12/1987 | Prentice | 244/155 R |
| 4,915,320 | 4/1990 | Neal | 244/155 A |

*Primary Examiner*—Joseph F. Peters, Jr.
*Assistant Examiner*—Anne E. Bidwell

[57] ABSTRACT

An apparatus used for securing sets of flexible strap handles of various sizes and shapes, and for retrieving, deploying, and storing the kite line attached to each flexible strap handle used when flying dual line kites. The invention includes an elongated tube with a rod extending perpendicular through the tube on both the upper and lower portion, each rod protruding equal distance on each side of the tube. A compression spring allows the upper rod to move closer to the lower rod, allowing flexible strap handles of various sizes and shapes to be secured onto the invention. The method of use of this invention allows sets of two flexible strap handles to be secured onto perpendicular rods, each handle attaching around an upper and lower rod on each side of the invention, then the kite line, which is secured to each handle, can be manually deployed or taken up onto this invention simultaneously by turning the tube on its axis. The method of use also allows the inserting of a battery-operated winder onto the end cap of the tube where a built-in winder attachment is located, to assist in the simultaneous retrieving of dual kite lines onto the invention at an increased speed. The built-in winder attachment also allows the use of a quick release clip which can be connected to the invention, allowing the kite flyer to connect the invention to his person.

4 Claims, 3 Drawing Sheets

SPRING-LOADED FLEXIBLE KITE STRAP HANDLE AND LINE CADDY

CROSS REFERENCES TO RELATED APPLICATIONS

| | | |
|---|---|---|
| 5,033,699 | 23 JULY 1991 | SATPATHY |
| 5,024,401 | 18 JUNE 1991 | NAKASHIMA |
| 4,714,217 | 22 DECEMBER 1987 | PRENTICE |
| 4,176,806 | 04 DECEMBER 1979 | KWON |
| 4,176,807 | 04 DECEMBER 1979 | KWON |

INTO THE WIND CATALOG, 1991, PAGES 19, 20, 21, 77, 78, 79.

BACKGROUND OF THE INVENTION/FIELD OF THE INVENTION

This invention relates in general to kites, and in particular to an apparatus for securing a set of flexible strap handles used during dual line kite flying, and deploying, retrieving, and securing the kite line attached to each handle, in a tangle-free, simple, and efficient manner.

BACKGROUND INFORMATION/DESCRIPTION OF RELATED ART

Kiting has been enjoyed in the past by all nations and all ages of peoples. Kiting has been used in times of wars as well as for individual pleasure. Much of the past was centered on one line kites with very little control. The purpose in flying kites was to extend the kite upward but only the wind could determine the direction or height the kite would go. With the introduction of two line kites, the kite flyer can control his kite from right to left, upward and downward, as well as in light or heavy winds. With two line control, the kite movements are unlimited as to the direction and speed it can perform. Dual line kiting has increased the interest of kite flying as a competitive sport as well as a personal hobby sport. This sport has gained international interest, with both children and adults participating in it as an individual sport or as a team sport. The increased enjoyment and the means of excelling in kite flying has shown that there is no set season for kite flying.

Kiting, like any sport, is more enjoyable if the time you spend at the sport is maximum and the before/after preparation is kept to a minimum. Kite flyers are people who often have a significant investment in their kite(s), lines, and other kite-related equipment. As in other sports and hobbies, kite flyers are looking for maximum pleasure and performance from each of their kiting experiences.

Many kite flyers prefer to fly with flexible strap handles or soft foam type handles. The problem arises for this type of handle because there is no place to store kite lines during non-use, nor is there a tangle-free, simple, efficient means of simultaneously deploying or retrieving the line that is attached to each handle. The duel lines need to stay separated and not become entangled during storage, deployment, and/or retrieval. One end of the kite lines attach securely to a bridle on the kite, and one end of the lines attach to handles kept in the hands of the kite flyer as he controls the speed, height, and maneuvers of his kite. Presently, the kite flyer must deploy or retrieve only one line at a time as he tries to maintain his line in good quality and straight order. The attempts to solve or remedy this problem have been to use a small flat piece of wood or similar hard object, that will allow the flexible strap handles to be slipped onto it. The kite flyer slips one handle onto the object, then winds the attached line around the object for storage. The kite flyer then slips the second handle onto the object and winds the attached line around the object for storage. The kite flyer reverses this action to deploy the lines and handles prior to flying. The present way of maintaining flexible strap handles and the kite line attached to each handle has been inadequate, time-consuming, and very awkward for the kite flyer. The kite line has a tendency to get twisted as the flyer manually loops it around the object. There is nothing available to assist the kiteflyer who prefers the flexible strap handles or soft foam type handles.

Each kite line is attached to the kite on one end and attached to some type of handle on the other end. Before retrieving the dual kite lines, each line is disconnected from the kite. The lines must be retrieved prior to transporting and storage, not allowing the two lines to become crossed or entangled at any time. Before deploying the kite lines, each line is attached to the kite. To prepare for kite flying, each line must be unwound and straightened out, not allowing the two lines to become crossed or entangled. The other end of the kite line is secured to the kite flyers handles at all times.

Over the years inventions have assisted in the retrieving and deploying lines for single line kites. There have been previous inventions marketed that will aid kite flyers who fly kites using hard handles, both for dual or quad line kites. These inventions have assisted kite flyers in the storage of their hard handles, as well as in deploying, retrieving, and storing their line. In order to provide background information so that my invention may be completely understood and appreciated in its proper context, reference is made to a number of prior art patents and publications as follows:

Patent granted Jul. 23, 1991, Satpathy U.S. Pat. No. 5,033,699 shows a system for kite string winding and unwinding, and gives the kite flyer control at launching and control once the kite is in the sky. This does not give a dual line kite flyer a means to secure flexible strap handles or assist in securing, deploying, or retrieving the kite lines attached to each flexible strap handle.

Patent granted Jun. 18, 1991, Nakashima U.S. Pat. No. 5,024,401 shows a control apparatus for quad-line stunt kites. This invention does not give a dual line kite flyer a means to secure flexible strap handles or assist in securing, deploying, or retrieving the kite line attached to each strap handle.

Granted Dec. 22, 1987, Prentice U.S. Pat. No. 4,714,217 shows a kite line take up device. This invention shows a means to attach hard control handles for storage, and a means of deploying and retrieving line. This particular invention can not be used if the kite flyer prefers to use flexible strap handles when kite flying. This invention does not give a dual line kite flyer a means to secure flexible strap handles or assist in securing, deploying, or retrieving the kite line attached to each strap handle.

Granted Dec. 4, 1979, Kwon U.S. Pat. No. 4,176,806 shows a reel assembly for controlling cord winding in kite flying. This invention is not able to be used with dual line and does not provide any means to secure any type of handles and line used for dual line kite flying.

Granted Dec. 4, 1979, Kwon U.S. Pat. No. 4,176,807 shows a kite-flying control reel. This invention does not give a dual line kite flyer a means to secure flexible strap handles or assist in securing, deploying, or retrieving the kite line attached to each strap handle.

Into The Wind 1991 Kite Catalog, pages 19, 20, 21, 77, 78, 79. This is one of the most popular and successful catalogs in the kite business today. The page references show single and quad line winder items, or dual line winders of hardwood or plastic handles. There is not a product available that gives a dual line kite flyer a means to secure flexible strap handles or an available product that assists in simultaneously deploying or retrieving, as well as securing the kite line attached to sets of flexible strap handles.

Of all the above mentioned line winders and reel assemblies, none serve a purpose in securing line that is attached to flexible kite strap handles of various sizes and shapes used during dual line kite flying. Whatever the precise merits, features, and advantages of the above cited references, not one of the prior inventions achieves or fulfills the purposes of the present invention. None of the prior inventions have the ability to store flexible strap handles of various sizes and shapes and assist in simultaneously retrieving or deploying, as well as securing kite line attached to each handle. None of the prior inventions allow an optional means of a battery operated winder to be attached onto the invention, to aid in the speed of simultaneously retrieving dual kite line. When flying dual line kites, the kite flyer is very mobile, and the prior inventions do not allow an optional means to attach the invention onto the person of the kite flyer for security, easy access to, and transporting of the invention. This invention assists the dual line kite flyer with a simple means of securing both his line and flexible strap handles of various sizes and shapes, and also allows assistance with simultaneously deploying or retrieving the kite line in a tangle-free, simple, and efficient manner.

SUMMARY OF THE INVENTION/DISCLOSURE OF THE INVENTION

It is an object of this invention to have a simple means of securing a set of two flexible strap handles and the line which is secured to each handle, for use with dual line kites, and to secure both handles and lines on a common apparatus while not in use.

It is a further object of this invention to have a means of securing sets of flexible strap handles of various sizes and shapes, thus assisting the dual line kite flyer who requires a means of maintaining more than one type set of flexible strap handles, and the line which is secured to each handle.

It is also an object of this invention to allow the dual line kite flyer a tangle-free, simple, and efficient means of retrieving and deploying his dual kite line simultaneously, while also maintaining the kite lines separate.

It is also an object of this invention that the kite flyer will have a means to maintain his dual kite lines separate and in a tangle-free manner during storage.

It is further stated that this invention allows the dual line kite flyer the optional means of attaching a battery-operated winder to the upper cap end of the invention, where a winder attachment is permanently located, to assist in retrieving the kite lines at an increased rate of speed while still maintaining a tangle-free, simple, efficient retrieval of both kite lines simultaneously, while also maintaining the kite lines separate.

It is further stated that this invention allows the dual line kite flyer, who is very mobile during kite flying, the option of attaching a standard quick release clip to the cap end of the invention where a winder attachment is permanently located, as a means of attaching the complete invention to the kite flyers person during kite flying to provide security, easy access to the invention, and transporting of the invention before, during, and after kite flying.

Briefly, the invention allows sets of flexible strap handles of various sizes and shapes, and the line connected to each handle, to be securely stored during non use. The invention allows a tangle-free, simple, and efficient means of deploying and retrieving the dual kite line simultaneously, while also maintaining the kite lines separate, with the option of attaching a battery-operated winder onto the invention to increase the speed of the actual kite line retrieval and the additional option of attaching a quick release clip to the invention as a means to secure it to the kite flyers person to provide security, easy access to the invention, and transporting of the invention before, during, and after kite flying.

The invention includes an elongated tube having a central axis, with permanent end caps, a rod going perpendicularly through the upper and lower portions of the elongated tube near the tube end caps, each rod positioned thru holes on either side of the elongated tube and extending out each side of the elongated tube at equal distances, and an internally positioned compression spring which allows the upper rod to be pulled closer to the lower rod when flexible strap handles of various sizes and shapes are secured firmly from the upper to the lower rod on either side of the elongated tube. Once the flexible strap handles are secured onto the invention by means of the rods, the kite flyer loosely holds the elongated tube on each end cap and manually rotates the elongated tube on its axis to retrieve the dual kite lines simultaneously. To deploy the dual kite lines, the kite flyer attaches the ends of the dual lines to the kite, loosely holds the elongated tube on each end cap and walks backward as tension is applied, causing the elongated tube to rotate on its axis, releasing the kite lines simultaneously.

BRIEF DESCRIPTION OF THE DRAWINGS

FIG. 3 is rotated on its axis to show the opposite side.

DESCRIPTION OF THE PREFERRED EMBODIMENT

Figure 8:
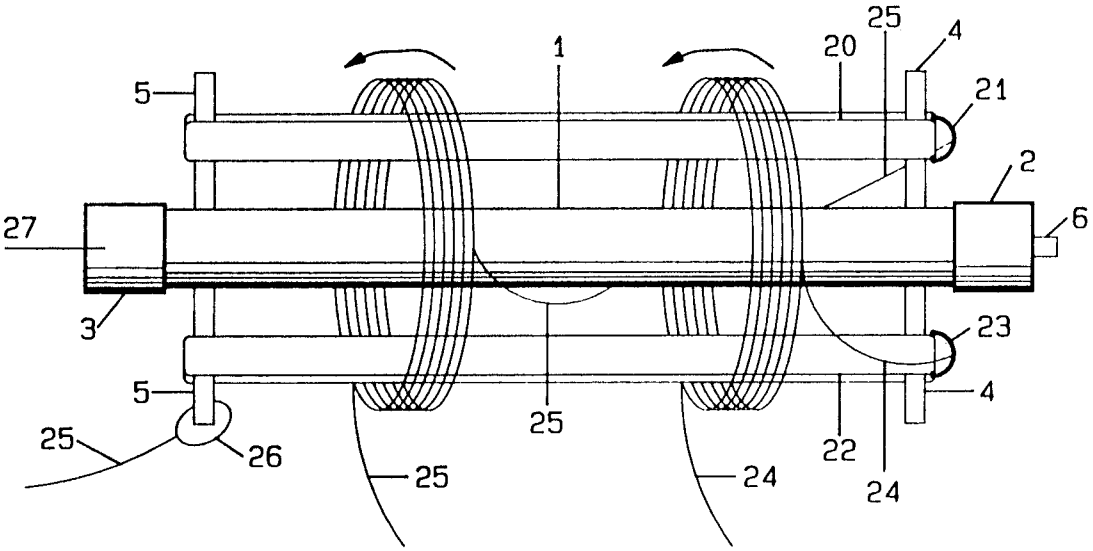
FIG. 8 is a representation of the invention from a lengthwise side elevation view, with the flexible strap handles attached to the invention, and the kite line partially wound onto the invention, illustrating the basic operation thereof.

Refer now to FIG. 8, which is an overall drawing of a preferred embodiment of the invention, illustrating the basic operation thereof. The invention is shown with a set of two flexible strap handles 20,22 respectively, each with one attached line 24,25 respectively. The flexible strap handles 20,22 respectively, and attached lines 24,25 respectively, are shown secured to the invention. The invention is shown as an elongated tube 1, with the top end capped 2, the bottom end capped 3, a perpendicular rod 4 going through the upper portion of elongated tube 1, and a perpendicular rod 5 going through the lower portion of elongated tube 1. Upper rod 4 and lower rod 5 extend out each side of elongated tube 1 at equal distances from elongated tube 1. Flexible strap handle 20 is attached to the invention by sliding the flexible strap handle onto upper rod 4, extending it to lower rod 5 and sliding the strap handle onto lower rod 5. Flexible strap handle 22 is attached to the invention in the same manner, using the upper rod 4 and lower rod 5 that extend out the opposite side from elongated tube 1. After the handles 20,22 respectively, are secured onto the invention, and kite lines 24,25 respectively, have been disconnected from the kite, the kite lines 24,25 respectively, are retrieved simultaneously onto the invention by holding end cap 2 in one hand and end cap 3 in one hand, then manually rotating the invention in a backward direction on its axis 27. Each kite line 24,25 respectively, is connected to a D-shaped metal ring 21,23 respectively, which is attached and sewn into each flexible strap handle 20,22 respectively. (The D-shaped metal rings 21,23 respectively, will be listed here for descriptive purposes only, due to each manufacturer having their own type of reinforcement on their flexible strap handles.) The kite lines 24,25 respectively extend for an average of seventy-five to one hundred fifty feet from each of the D-shaped metal rings 21,23 respectively, to the kite. Once the kite lines 24,25 respectively, are retrieved completely, FIG. 8 shows a loop or swivel 26 on the end of line 25 that can be secured to the invention by allowing the loop or swivel 26 to be placed over one of the perpendicular rods, either upper rod 4 or lower rod 5. Line 24 can be secured in this same manner. Attachment 6 on end cap 2 is for optional uses explained later.

Figure 9:
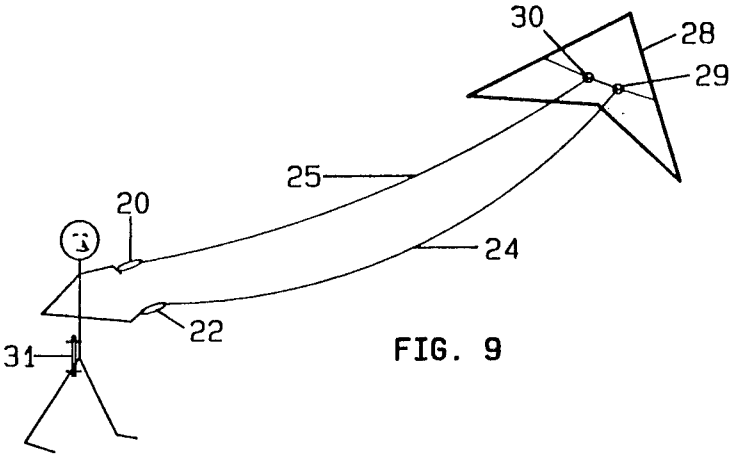

To deploy the kite lines 24,25 respectively, each loose end of the kite line 24,25 respectively, is attached to the kite. The kite flyer holds elongated tube 1, loosely in each hand, one hand on each end cap 2, 3 respectively. The kite flyer walks backward, letting the slight tension of the kite lines 24,25 respectively, rotate elongated tube 1 forward on its axis 27, simultaneously unwinding the kite lines 24,25 respectively. Once the kite lines 24, 25 respectively, are completely unwound from elongated tube 1, the flexible strap handles 20,22 respectively, are removed from the upper and lower rods 4,5 respectively, and placed over the hands of the kite flyer, ready for kite flying with dual kite lines. The FIG. 9 shows a kite flyer flying a dual line kite. Flexible strap handles 20,22 respectively, are around each wrist of the kite flyer, the lines 24,25 respectively, attach to the handles 20,22 respectively, and extend to the kite 28, connecting to kite 28 at points 29,30 respectively. The kite flyer is also shown with the invention apparatus 31 attached to his person during kite flying.

Figure 6:
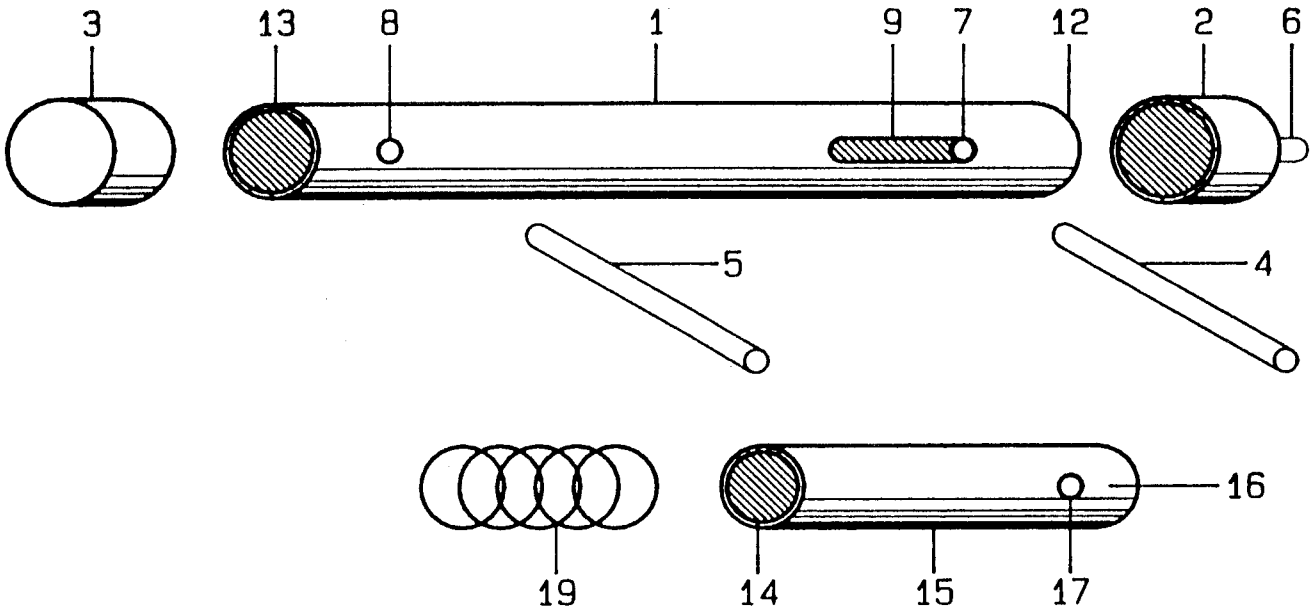
FIG. 6 is a representation of the invention from a lengthwise side elevation view, with all parts broken away and displayed individually.

The FIG. 6 shows the additional inside parts of elongated tube 1, including a compression spring 19 that allows upper rod 4 to maintain tension and move within opening 9 so that flexible strap handles of varying sizes and shapes can be stretched from upper rod 4 to lower rod 5 and secured onto the invention.

The portions of this invention referred to as the tubes 1,15 respectively, and end caps 2,3 respectively, are preferably made from PVC pipe, but not limited to this material. This invention can be made from other types of materials such as wood. It is best to use materials that are lightweight, weather resistant, rust resistant, yet strong and durable. The portion of this invention referred to as the upper and lower rods 4,5 respectively, are made from very strong metal, but not limited to this material.

Figure 1:
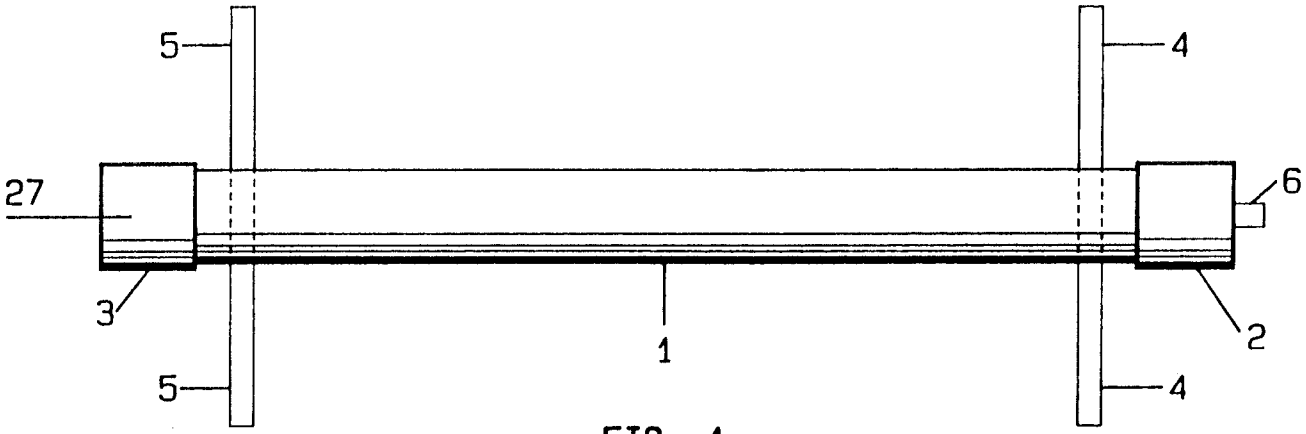
FIG. 1 is a representation of the invented device from a lengthwise overall elevation perspective view thereof.

Reference now to FIG. 1, which is an overall drawing of the invention. FIG. 1 shows an elongated tube 1, having end cap 3 secured over the bottom of elongated tube 1, and end cap 2 secured over the top opening of elongated tube 1, a metal winder attachment 6 extending out of end cap 2, a small cylindrical lower rod 5 secured perpendicularly through the bottom portion of elongated tube 1, and a cylindrical upper rod 4 of the same size and shape as lower rod 5, going through the top portion of elongated tube 1. Both end caps 3, 2 respectively, fit securely and permanently onto elongated tube 1. Upper rod 4 and lower rod 5 penetrate through elongated tube 1 and extend perpendicular to and equal distance out from either side of elongated tube 1. The axis 27 is shown for rotation of the invention, as a means of movement to retrieve and deploy kite line with this invention.

Figure 2:
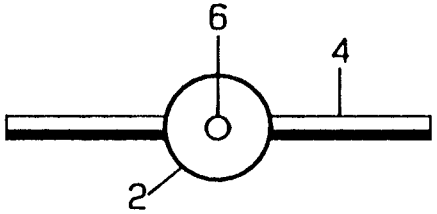
FIG. 2 is a representation of the invented device from a top perspective view thereof, specifically, the right (top) end portion of the device of FIG. 1.

FIG. 2 shows a top view, looking at end cap 2, of how upper rod 4 is perpendicular to elongated tube 1, and extends equally out each side of elongated tube 1 as shown in FIG. 1. The winder attachment 6 on end cap 2 is shown in FIG. 2 as being centered on the end cap 2 and is permanently attached to the invention for optional uses discussed later.

Figure 3:
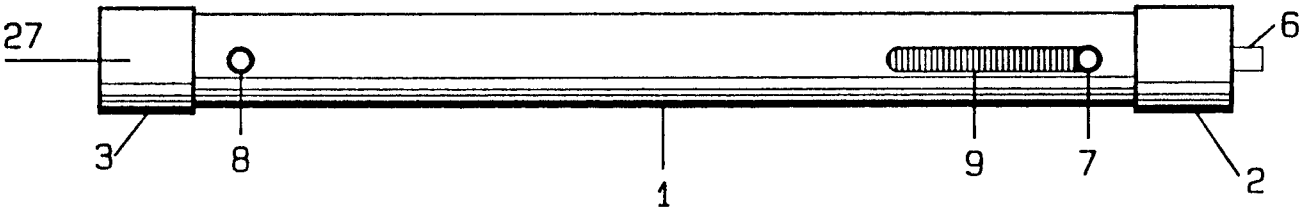
FIG. 3 is a representation of the invented device from a fragmentary lengthwise side elevation view thereof.
Figure 5:
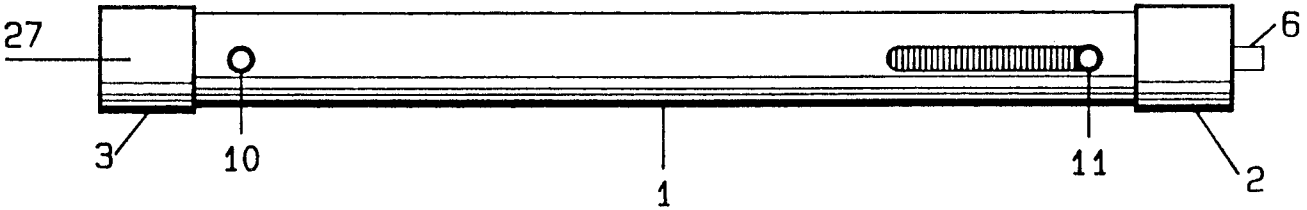
FIG. 5 is a representation of the invention from the opposite fragmentary side of the elevation view thereof shown in FIG. 3, when

FIG. 3 shows where upper rod 4 in FIG. 1 goes through elongated tube 1 at hole 7. FIG. 5 is the opposite side of FIG. 3, when FIG. 3 is turned on its axis 27. Upper rod 4 as shown in FIG. 1, goes through hole 7 as shown in FIG. 3, and extends through elongated tube 1, continuing out opening 11 as shown in FIG. 5, until equal lengths of upper rod 4 is showing out either side of elongated tube 1 as shown in FIG. 1. FIG. 3 also shows where lower rod 5 in FIG. 1 goes through elongated tube 1 at hole 8, as shown in FIG. 3, and extends through elongated tube 1, continuing out hole 10 as shown in FIG. 5, until equal lengths of lower rod 5 is showing out either side of elongated tube 1 as shown in FIG. 1. As shown in FIG. 1, upper rod 4 and lower rod 5 are of the same size and length, and are attached permanently through elongated tube 1 so as to not be able to be removed or have upper rod 4 or lower rod 5 extend out of elongated tube 1 at different lengths.

Figure 4:
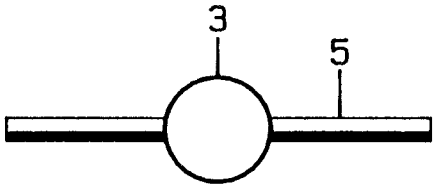
FIG. 4 is a representation of the invention from a bottom perspective view thereof, specifically, the left (bottom) end portion of the device of FIG. 1.

FIG. 4 shows a bottom view looking at end cap 3, of how lower rod 5 is perpendicular to elongated tube 1, and extends equally out each side of elongated tube 1, in the same manner as FIG. 2 shows rod 4, and as shown in FIG. 1.

FIG. 3 shows opening 9 in the side of elongated tube 1, which includes hole 7, and extends towards hole 8. FIG. 5 shows the opposite side of elongated tube 1 as shown in FIG. 3, when elongated tube 1 is rotated on its axis 27. Hole 11 extends in length and size to equal opening 9 as shown in FIG. 3. Opening 9 allows upper rod 4 as shown in FIG. 1 to slide closer to rod 5 in FIG. 1.

Figure 7:
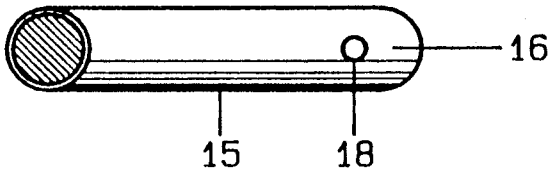
FIG. 7 is a representation of the invention showing the opposite side of the inner tube shown in FIG. 6, when the inner tube is rotated on its axis to show the opposite side.

Reference now FIG. 6, tube 15 is inserted into elongated tube 1 through opening 13. The outer diameter of tube 15 is equal to the inner diameter of elongated tube 1. FIG. 7 is the opposite side of FIG. 6, tube 15, when tube 15 is turned on its axis 16 as shown in FIG. 7. FIG. 7 shows tube 15, opening 18 is the opposite side of tube 15 hole 17 in FIG. 6. Upper rod 4 is inserted into hole 7 of elongated tube 1, hole 17 of tube 15 in FIG. 6, and hole 18 of tube 15 in FIG. 7, and through hole 11 of elongated tube 1 shown in FIG. 5. This secures tube 15 as shown in FIG. 6, to the inside of elongated tube 1. Spring 19 is then inserted into elongated tube 1 through opening 13. Continuing to reference FIG. 6, the compression spring 19 has a larger diameter than the inner tube 15 at tube end 14. There is pressure on upper rod 4, as the spring pushes on tube 15, at inner tube end 14. Once spring 19 is placed inside elongated tube 1, lower rod 5 is put through hole 8 in FIG. 6, and hole 10 in FIG. 5. Lower rod 5 extends equally on either side of elongated tube 1 as shown in FIG. 1. End cap 2 is securely and permanently attached to elongated tube 1 on end 12. End cap 3 is securely and permanently attached to elongated tube 1 on end 13. The compression spring 19 and tube 15 inside elongated tube 1 are permanently secured between upper rod 4 and lower rod 5. Pressure is caused on upper rod 4 as the spring 19 pushes on tube 15 at inner tube end 14. Upper rod 4 is able to move parallel with elongated tube 1, within opening 9, tension being maintained on upper rod 4 as it it moved closer to lower rod 5. As upper rod 4 moves within opening 9, FIG. 6, it is also moving within opening 11, FIG. 5, the opposite side of elongated tube 1. As flexible strap handles of various sizes and shapes are attached on either side of elongated tube 1 from upper rod 4 to lower rod 5, as shown in FIG. 8, to secure smaller sized handles, upper rod 4 is able to be placed closer to lower rod 5, and the compression spring 19 allows the tension needed to secure smaller sized handles to rods 4, 5, respectively. The opening 9 in FIG. 6 extends from hole 7 for this reason.

FIG. 8 shows the use and operation of this invention. During storage times, flexible strap handles used by the dual line kite flyer are placed on either side of elongated tube 1, and are placed to securely mount from upper rod 4 to lower rod 5, one flexible handle on each side of elongated tube 1 where upper rod 4 and lower rod 5 extends perpendicular from elongated tube 1. If the flexible handles are small or made from a soft foam rubber type material, upper rod 4 moves closer to lower rod 5, and is pulled towards lower rod 5, tension being maintained, until the handles are able to fit over both of the rods securely, as shown in FIG. 8. Flexible strap handles 20,22 respectively, are shown in the secured position on the invention. The inner diameter of flexible strap handles may be different due to the difference in materials and manufacturers. This is the reason for this invention to allow upper rod 4 to move parallel with elongated tube 1, closer to lower rod 5, when needed. Upper rod 4 will be forced by compression spring 19, FIG. 6, to be in the maximum outward position, for use with the larger inner diameter flexible strap handles. Upper rod 4 is adjustable in position so that flexible strap handles of various sizes and shapes can be securely attached from upper rod 4 to lower rod 5 by the tension being placed on upper rod 4.

Continuing to reference FIG. 8, where the handles have been brought together to form a loop, manufacturers have some type of metal reinforcement attachment for added strength in securing the kite line to the handle. FIG. 8 shows handle 20 with a D-shaped metal ring attachment 21 and handle 22 with a D-shaped metal ring attachment 23. Line 24 attaches to the end of handle 22 at metal reinforcement 23 and line 25 attaches to the end of handle 20 at 21. The kite flyer will not usually change the line attached to his handles until the line needs to be replaced. If he wants to fly a kite with a different type of line he usually has more than one set of handles and line, so each set of lines will be a permanent attachment to each set of handles a kite flyer owns. Therefore, the kite flyer must maintain each set of handles and line he acquires. The kite line is wound around elongated tube 1, and around both handles 20,22 respectively, which are now securely on elongated tube 1 from upper rod 4 to lower rod 5. Each kite line 24,25 respectively must be maintained separately at all times, to assure that during the deploying, retrieving, or storing, the lines will not become entangled. This is the reason that the lines are shown in FIG. 8 to be separated. By holding one hand onto end cap 2 and one hand onto end cap 3, the kite flyer will manually rotate the invention on its axis 27 until the lines 24,25 respectively, have been completely and simultaneously retrieved. To manually rotate elongated tube 1, the kite flyer moves his fingers to rotate the invention on its axis 27. After winding the lines 24,25 respectively, around elongated tube 1 and the attached straps 20,22 respectively, as shwon in FIG. 8, each of the kite lines 24,25 which had been attached to the kite will have a swivel hook attached to the end or a loop made from the same line which can be securely looped around upper rod 4 or lower rod 5 as shown in FIG. 8, line 25, loop 26.

To simultaneously deploy lines 24,25 respectively, the end loops of each line are removed from around upper rod 4 or lower rod 5, as shown in FIG. 8, by the end loop 26 on line 25. The ends of both kite lines 24,25 respectively, are connected to the kite, then the invention is held lightly on end cap 2 with the right hand and end cap 3 with the left hand, as the kite flyer walks backward, letting the invention turn on its axis 27 as the invention rotates, allowing the lines to deploy simultaneously, simply, efficiently, and tangle-free. This can be done with one person since there is very little tension needed to rotate the invention as the line is deployed.

The extended winder attachment 6 on end cap 2 FIG. 8 is a permanent part of the invention that allows the kite flyer two additional options. A battery operated winder will securely fit onto the extended winder attachment 6 allowing the kite flyer to retrieve his lines 24,25 respectively, at an increased rate of speed. One hand is held on the winder, which the invention has been attached to, and one hand allows lines 24,25 respectively, to run through the fingers of the kite flyer as a means of "separation" as the lines quickly, efficiently and tangle-free, becomes simultaneously wound around elongated tube 1 and the secured handles 20,22 respectively. The battery powered winder automatically turns the elongated tube 1 on its axis 27, in the same manner as the kite flyer manually turned elongated tube 1 to retrieve the kite lines 24,25 respectively.

The extended winder attachment 6 also allows a quick disconnect release to be inserted into the extended winder attachment 6 as a means of securing this invention to the kite flyers' clothing by means of a quick release clip attachment, to be used during transportation, or actual kite flying, for security and quick access to the invention before, during, and after flying.

This invention has fulfilled the objects of the invention that have been stated previously. With this invention, a kite flyer who flies dual line kites, whether as a sport, for pleasure, or competition, will have a simple means of securing his set of two flexible strap handles and the lines attached to each. A kite flyer will have a means to maintain his dual kite lines separately, and in a tangle-free manner during storage as well as keeping the lines separate and tangle-free as he simultaneously deploys and retrieves his kite line. The kite flyer will be able to utilize this invention with flexible strap handles of various sizes and shapes.

The optional use of the attachment will allow the kite flyer a means of simultaneously retrieving lines at an increased rate of speed. The optional use of the attachment will also allow the kite flyer to keep the complete invention attached to his person during transportation or actual kite flying, for security and quick access to the invention before, during, and after kite flying, by attaching a quick release clip to the end cap attachment of the invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. An apparatus for use with dual line flexible kite strap handles of various sizes and shapes and the lines attached to each, comprising:

(a) an elongated tube having a central axis and two end caps, each cap permanently secured to each end of the elongated tube; and (b) two rods placed perpendicular through the elongated tube, positioned through holes on either side of the elongated tube, extending out of each side of the elongated tube at equal distances, each rod positioned near the end caps of the elongated tube; and (c) a smaller inner tube secured inside the elongated tube by the upper rod which is placed through holes on either side of the smaller tube, whose holes align with holes positioned on the elongated tube and allow the upper rod to secure the smaller tube inside the elongated tube; and (d) an inner compression spring which fits inside the elongated tube between the inner tube and the lower rod which is permanently positioned perpendicular to the elongated tube through holes on each side of the elongated tube; and (e) a winder attachment located on the upper end cap, securely and permanently attached to the end cap of the elongated tube.

2. The apparatus device of claim (1) further comprising a narrow opening on the side of the elongated tube, parallel with the elongated tube, encompassing the hole of the elongated tube which the upper rod has been placed through, the opening being the width of the upper rod, which allows the upper rod to be pulled towards the lower rod, and the inner compression spring causes tension to the upper rod as the rod is moved to different positions.

3. The apparatus device of claim (1) further comprising a means for the permanent winder attachment located on the end cap of the elongated tube, being of a standard size in which a battery operated winder can be attached to the winder attachment.

4. The apparatus device of claim (1) further comprising a permanent winder attachment located on the end cap of the elongated tube, being a standard size in which a quick release clip can be attached to the winder attachment.

* * * * *